United States Patent [19]

Sornsin

[11] 4,200,423

[45] Apr. 29, 1980

[54] STORABLE BOOM ATTACHMENT FOR A CONSTRUCTION MACHINE

[76] Inventor: Earl W. Sornsin, 1743 S. 9th St., Fargo, N. Dak. 58102

[21] Appl. No.: 937,992

[22] Filed: Aug. 30, 1978

[51] Int. Cl.[2] ..... B66C 23/54; B66F 9/00

[52] U.S. Cl. ..... 414/724; 37/117.5; 37/DIG. 3; 37/DIG. 12; 414/607

[58] Field of Search ..... 414/607, 697, 722, 724, 414/912; 37/117.5, DIG. 3, DIG. 12

[56] References Cited

U.S. PATENT DOCUMENTS

| | | | |
|---|---|---|---|
| 3,587,887 | 6/1971 | Carli | 414/724 X |
| 3,812,979 | 5/1974 | Leihgeber | 37/117.5 X |

*Primary Examiner*—Robert G. Sheridan

*Assistant Examiner*—George F. Abraham

*Attorney, Agent, or Firm*—Schroeder, Siegfried, Ryan, Vidas, Steffey & Arrett

[57] ABSTRACT

This invention relates to a storable hoisting gin or boom member attachment for bucket loaders which provides an arrangement for quickly and easily moving a boom member or gin pole into working relationship with respect to a bucket loader so that this type of construction vehicle may be used for lifting and lowering objeccts in construction work. The attachment consists of supports welded to the top side of the bucket, each support including a pivot flange and a retaining flange to which the boom or gin is attached. Each pivot flange permits pivoting of the boom member to a collapsed position on an opposite support on the top side of the bucket for storage purposes.

11 Claims, 4 Drawing Figures

Fig. 1
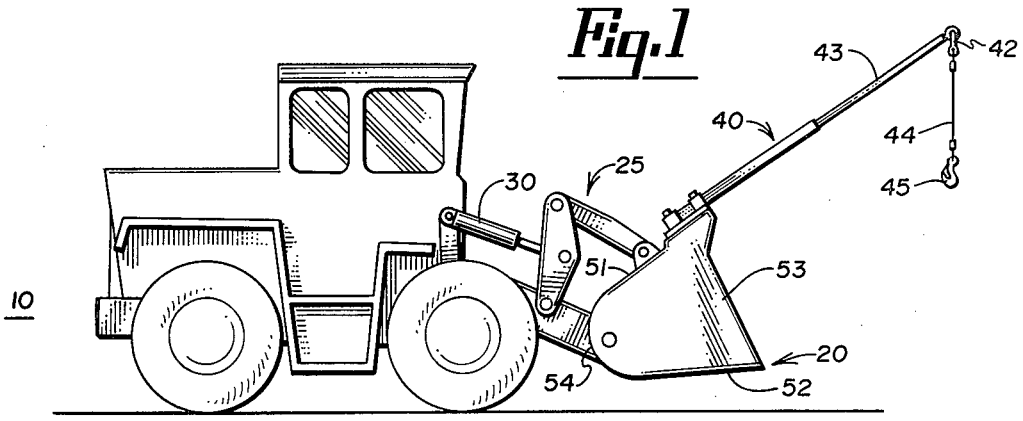
Fig. 4
Fig. 2
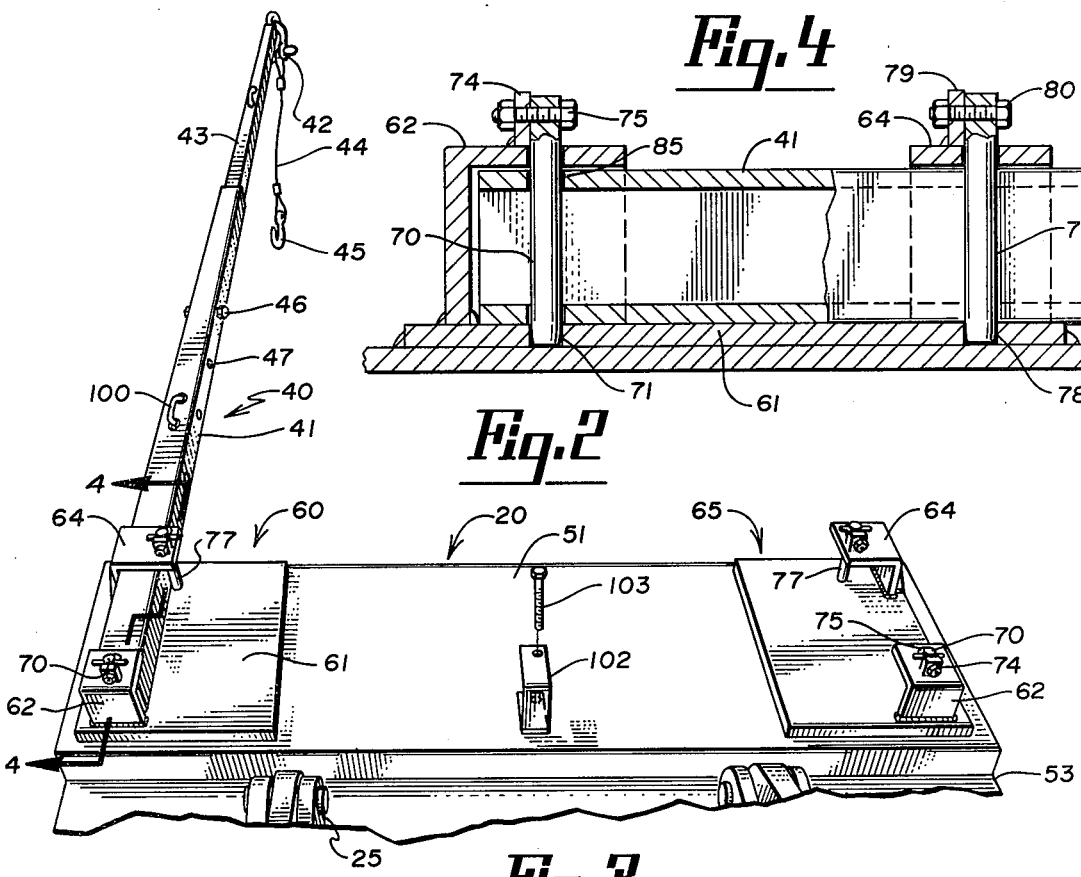
Fig. 3
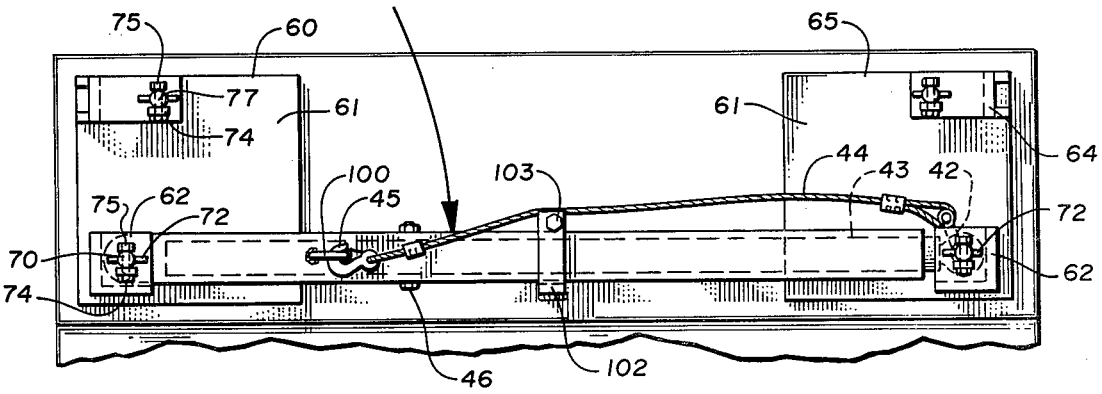

STORABLE BOOM ATTACHMENT FOR A CONSTRUCTION MACHINE

FIELD AND BACKGROUND OF THE INVENTION

This invention relates to construction or excavating equipment and, more particularly, to modifying equipment such as a front end loader or bucket loader with a hoisting gin or boom member so that equipment may be used for lifting or lowering objects in construction work, in addition to such normal work as trenching or excavating.

Equipment, such as bucket loaders, have been modified in the past to mount or carry boom members or cranes for special lifting applications. Normally such loaders are utilized for excavating and loading. With the addition of the boom attachment, the equipment is utilized for lifting objects such as pipe in the construction of sewers and drainage systems. The boom or crane attachments in the past have required a significant number of connections to the bucket or support such that the installation of the same is time consuming. More importantly, there is no provision on such construction equipment for storing the attachment when it is not in use. Consequently, a problem exists of having the attachment available and in proximity at a work site in order to facilitate connection and disconnection of the same. This contributes to time delays and adds to the cost of usage and operation of the equipment. Examples of such prior constructions are shown in the United States Patents to Swanson U.S. Pat. No. 3,092,259; Foster, U.S. Pat. No. 3,249,245 and DeCarli, U.S. Pat. No. 3,587,887.

SUMMARY OF THE PRESENT INVENTION

The present invention is directed to a hoisting gin or boom attachment for construction equipment in which the gin or boom member is storable on the equipment so that it is available for usage at all times. Further, it may be set into a position of usage in the minimum amount of time, significantly reducing the cost of operation of the same. The improved boom attachment or gin pole is specifically adapted to be mounted on the bucket of a front end loader. The bucket of the loader is modified to provide a pair of supports on the upper side of the bucket adjacent the sides thereof. Each support includes a pivot member and a retaining flange with the pivot member being positioned rearwardly of the retaining flange. The boom member may be selectively attached to either support and is coupled to the pivot member through a pivot pin extending through the pivot member and fitted through an aperture in one end of the boom member to secure the same to the support. The pins are removable to provide for interchange of the boom member in one or the other of the supports. The retaining flange of the support is a generally right angle bracket with a removable pin which is adapted to extend vertically through the end of the flange alongside of the boom member and retain the same therein, holding the boom member to prevent pivotal movement of the same within the support. The boom member extends beyond the forward edge of the bucket and may be formed of telescopic parts to adjust the length of the same. Suitable apertures and pins in the boom member will adjust and retain the length of the same. The end of the boom member mounts a universal swivel with a piece of cable attached thereto, the cable having a safety lifting hook on the end of the same. The cable is adapted to connect objects, such as pipes, to the end of the boom member for lifting or lowering purposes, and the boom member will be moved with the bucket to which it is attached through a tilting and elevating motion conventional with front end loaders or bucket loaders.

When the boom member is not in use, it may be collapsed and stored on the upper edge of the bucket by removing the pin in the retaining flange and pivoting the boom member to the opposite support where it may be connected to either the retaining flange or the pivot member of the opposite support. A U-shaped bracket is positioned on the upper edge of the bucket intermediate the supports to aid in supporting the boom member in a stored position.

The boom member also includes a loop welded to the side of the same to which the lifting hook of the cable may be attached to dispose the cable along the side of the boom member in the stored position when not in use.

The invention will be best understood in connection with the attached drawings wherein:

IN THE DRAWINGS

FIG. 1 is a side elevation view of a construction machine, such as a front end loader, with a boom member or gin pole attachment thereon;

FIG. 2 is a top perspective view of the bucket of a front end loader with a boom member thereon;

FIG. 3 is a top elevation view with the boom member in a stored position; and, FIG. 4 is a sectional view of the boom attachment of FIG. 2 taken along the lines 4—4 therein.

DESCRIPTION OF THE PREFERRED EMBODIMENT

FIG. 1 shows a construction machine, such as a front end loader or bucket loader, to which the storable boom member or gin pole is normally attached. The front end loader, indicated generally at 10, may take varying forms. The front end of the machine mounts a bucket 20 which is coupled to the front end of the machine through various linkages 25 and actuators, indicated generally at 30, to enable the bucket to be pivoted about an axis transverse to the extent of the machine and elevated or lowered on the linkages. Such machines are normally used for excavation-type work or loading since the bucket may be elevated and pivoted for loading purposes and lowered so that the edge of the bucket bites into or moves along the ground surface for excavation purposes. To extend the usage of such a machine, a boom member 40 or hoisting gin pole may be coupled to the bucket, enabling the machine to lift articles and lower the same in varying construction type operations. It has a swivel 42 mounted at the end of the same with a suitable cable 44 attached to the swivel, the cable having a safety lifting hook 45 at the end of the same, enabling the cable to be attached to a sling or choker (not shown) or to be secured around an object to lift or lower the same.

As will be seen in FIGS. 1 and 2, the bucket 20 is normally formed with an inclined upper or top side 51 and a lower bottom side 52 surface with sides 53 joined thereto. It includes a rear surface 54, leaving an open front face which has a greater area then the rear side of the bucket.

As will be seen in FIG. 2, the supports for the gin pole or boom member are mounted on the forward edge of the upper side of the bucket. Thus, as is indicated in FIG. 2, supports 60 and 65, which are similar in construction, are mounted on the forward edge of the upper side of the bucket adjacent the sides thereof. Each support is comprised of a base plate 61 generally square or rectangular in section, which is welded to the top side of the bucket. The base plate mounts a pivot flange 62 on the rear edge of the plate 61 and a retaining flange 64 forward of the same and adjacent the front edge of the bucket. The pivot flange is preferably formed of two upstanding right angle sides which are common to the outside edge of the bucket and the rear edge of the base plate, the sides being welded to the base plate and to a top plate overlying the sides.

As will be seen in FIG. 4, a suitable pivot pin 70 is positioned through an aperture in the top of the pivot flange and extends to an aperture 71 in the base plate aligned therewith. The pivot pin has a T-shaped handle 72 on the top side of the same and a suitable rib 74 welded to the top side of the pivot flange has an aperture therethrough by means of which a suitable nut and bolt 75 may pass through the rib and an aperture in the pin to retain the pin on the top of the pivot flange. The retaining flange 64 or locking member is generally an L-shaped member welded to the base plate to give a U-shaped configuration with a closed side common to the edge of the bucket and open toward the center, front and rear of the bucket. A suitable retaining pin 77 extends through an aperture in the flange and into an aperture 78 in the base plate to hold the pin therein. The retaining flange similarly has a rib 79 at the top edge of the same through which a bolt 80 is positioned and through an aperture in the pin to secure the pin to the retaining flange. Pin 77 is positioned near the open face of the retaining flange such as to extend vertically along the side of the boom member, as will be hereinafter defined.

Boom member or gin pole 40 is a generally elongated structure formed of telescopic parts 41, 43 which may be square or round in cross-section and slidable one within the other. Suitable apertures 47 in the extent of the gin pole or boom permit the boom member to manually be extended or retracted and retained in position by pins 46 which pass through the apertures. The pivot end of the boom member 40 or the telescopic part 41 as shown in FIGS. 1 and 2 has an aperture 85 extending therethrough by means of which the boom member may be mounted in the pivot flange 62 of the support. The pivot pin 70 extends through the pivot flange and the aperture 85 in the telescopic part 41 of the boom member or gin pole to secure the same to the support. The pin may be removed and the boom member selectively positioned in one or the other of the supports 60 or 65. The retaining flange 64 serves as a locking member to hold the boom in a forward extended position with respect to the bucket when in use. The boom will fit within the U or L-shaped configuration of the retaining flange and the pin 77 extends therethrough will hold the boom member in a locked position.

The end of the boom member or gin pole mounts the swivel 42 which is preferably universally mounted in the telescopic part 43. The cable 44 is attached thereto and the safety lifting hook 45 at the end of the same will enable the cable to be secured to a sling or choker placed around the object, such as a pipe, to secure the same to the cable for lifting and lowering the pipe, such as in a sewer construction. The length of the boom part 41 or the boom member when collapsed is basically the same as the width of the bucket or the distance between the pivot members 62 on the supports 60 and 65. When the boom member or gin pole is not in use, the pin 77 of the retaining flange 64 will be removed, allowing the boom to be pivoted into alignment with opposite support. The swivel 42 at the end of the same may be secured by the pin of the opposite retaining flange or the pin of the opposite pivot flange to secure the boom or gin pole in a stored position. An intermediate support flange 102 is also mounted on the center of the bucket on the top side thereof between the supports 60, 65 which support flange is generally U-shaped in form and open facing forward to receive the boom in the stored position and aid in securing the same to the bucket. The safety lifting hook 45 in the stored position is connected to a loop 100 mounted on the top of the gin pole or boom member to store the cable when the boom is folded onto the upper surface of the bucket.

The improved hoisting gin pole or storable boom member may be readily removed from its mounting in one support and positioned in the other support, depending upon the desired location of the same with respect to the bucket. Similarly, the boom may be moved from the stored position and retained in a forward working position by the respective retaining flanges. The boom may be extended or retracted as desired, and the cable thereon will connect to the object which may be raised or lowered through pivot of the bucket by the linkages connecting the bucket to the machine.

In usage, the improved front end loader or bucket loader may be readily modified or set up to perform lifting operations with a boom member merely by placing the boom in an extended position and coupling the same through the retaining flange. Objects may be raised or lowered by moving the bucket and the storable boom may be readily stored on the machine when not in use so that it is readily available for usage at any time. It may be placed into operation with a minimum amount of effort and time to significantly enhance the overall performance of the machine.

In considering this invention, it should be remembered that the present disclosure is illustrative only and the scope of the invention should be determined by the appended claims.

I claim:

1. A hoisting gin comprising:

(a) a front-end loader having a pivotally mounted bucket extending transversely thereof at its forward end;

(b) said bucket having end and upper and lower side walls;

(c) a pair of oppositely disposed anchor members mounted upon an upper surface of said upper side wall of said bucket in laterally spaced relation adjacent opposite ends of said bucket and each constructed and arranged to pivotally anchor a gin pole upon said bucket;

(d) a longitudinally telescopic gin pole constructed and arranged to have its inner end received within one of said anchor members in pivoted anchored relation for pivotal movement about a substantially vertical axis between an anchored forwardly extending working position and a transverse stored position adjacent the other of said anchor members;

(e) a pole-locking member mounted on said upper surface of said upper side of said bucket forwardly of one of said anchor members and constructed and arranged to engage and releasably lock said gin pole in extended working position when said gin pole is pivoted to forwardly extending position relative to said bucket and said anchor members; and, (f) said gin pole being telescopic to a length approximating the distance between said pair of anchor members and having its outer end constructed and arranged to be engaged and secured by said other anchor member when said gin pole is so telescoped and pivoted to its stored position whereat it extends transversely of said loader and longitudinally of its said bucket.

2. A storable boom for use with a construction machine having a scoop type bucket mounted on one end of the machine through linkages for elevating and pivoting the bucket about an axis extending transverse of the machine, the bucket having upper and lower sides with connecting end walls and with the lower side being adapted to be disposed on the ground when the bucket is pivoted forward, comprising: a boom member, a support adapted to be mounted on the upper side of the bucket adjacent one end thereof, said support including a pivot flange and retaining flange with the pivot flange positioned rearwardly of the retaining flange and releasably mounting one end of the boom when so mounted upon the bucket and with the retaining flange selectively retaining the boom against pivotal movement, said boom member having a length and being mounted in said support to extend beyond the bucket when in use and being pivoted on the support into alignment with the upper side of the bucket when stored; and means adapted to be positioned on the upper side of the bucket adjacent the opposite end thereof for retaining the other end of the boom member on the upper side of the bucket when stored.

3. The storable boom of claim 2 in which the means positioned on the upper side of the bucket is a second support including a pivot flange and retaining flange, said boom member being selectively mountable in either the first or second support.

4. The storable boom of claim 2 in which the boom member is formed of telescopic parts adapted to extend and including means for selectively holding said boom member in an extended or retracted position.

5. The storable boom of claim 2 in which said pivot flange is a flange member having a removable pin positioned therethrough and in which the end of said boom member mounted therein has an aperture therein through which the pin is positioned.

6. The storable boom of claim 5 in which said pivot flange includes means for retaining said pin therein.

7. The storable boom of claim 5 in which said retaining flange is a right angle bracket member with a removable pin positioned therethrough to extend vertically along the side of and hold said boom member.

8. The boom support of claim 3 and including an intermediate U-shaped support member adapted to be mounted on the upper side of the bucket intermediate the first and second supports and adapted to support a portion of said boom member in the stored position.

9. The boom support of claim 3 and including swivel means mounted on the outer end of said boom member with a cable having a lifting hook at the end of the same for connecting the cable to loads to be supported by said boom member.

10. The boom support of claim 2 and including coupling means mounted on the outer end of said boom member and adapted to couple said boom member to a load, said coupling means also being adapted to couple to said means positioned on the upper side of the bucket adjacent the opposite end thereof to retain the other end of said boom member on the upper edge of said bucket in the stored position.

11. The boom support of claim 9 and including loop means mounted intermediate the extent of said boom member and adapted to receive the lifting hook in the stored position.

* * * * *